US005952626A

United States Patent [19]

Zaharia

[11] Patent Number: 5,952,626

[45] Date of Patent: Sep. 14, 1999

[54] INDIVIDUAL ELEVATOR CALL CHANGING

[75] Inventor: Vlad Zaharia, Rocky Hill, Conn.

[73] Assignee: Otis Elevator Company, Farmington, Conn.

[21] Appl. No.: 09/111,077

[22] Filed: Jul. 7, 1998

[51] Int. Cl.[6] ..... B66B 1/16; B66B 1/34

[52] U.S. Cl. ..... 187/381; 187/392; 187/395

[58] Field of Search ..... 187/380, 381, 187/392, 395

[56] References Cited

U.S. PATENT DOCUMENTS

| | | | |
|---|---|---|---|
| 4,558,298 | 12/1985 | Kawai et al. | 340/19 R |
| 4,662,479 | 5/1987 | Tsuji et al. | 187/131 |
| 5,689,094 | 11/1997 | Friedli et al. | 187/384 |

FOREIGN PATENT DOCUMENTS

| | | | |
|---|---|---|---|
| 5-278962 | 10/1993 | Japan | 187/392 |

*Primary Examiner*—Robert E. Nappi

[57] ABSTRACT

A personal remote control device exchanges electromagnetic transmissions with an elevator system, each transmission including the identification number of the device, whereby requests for elevator service made by means of the device are unique to that device, and requests can be made by the device to cancel or change any request for elevator service which has previously been made. The remote control device may either be verbal, communicating with the user by means of speech synthesis and voice recognition, or the device may utilize switches, displays or other mechanisms for interaction with the user.

16 Claims, 9 Drawing Sheets

INDIVIDUAL ELEVATOR CALL CHANGING

RELATED APPLICATION

Some of the matter disclosed herein is disclosed and claimed in commonly owned U.S. patent application Ser. No. 09/111,355 filed contemporaneously herewith.

TECHNICAL FIELD

This invention relates to changing elevator service calls in response to messages transmitted by electromagnetic radiation between the elevator system and a portable device borne by a user.

BACKGROUND ART

Elevator systems have recently been provided with two features which are thought to save considerable passenger time and increase the carrying capacity of a given elevator installation. The first of these is utilizing destination calls, by which the passenger does not simply call an elevator to his floor, but at the same time informs the elevator of the intended destination floor. This allows the dispatcher (typically a suitably programmed computer) to allocate the call to the most appropriate car, taking into account not only the origin, but also the destination of the passenger.

A second feature causes passengers to enter their calls while still at some distance (equivalent to about ten seconds, in one case) from the elevator, whereby the dispatcher can attempt to cause the elevator to arrive at nearly the same time that the passenger reaches the elevator. In one case, the advance calls are entered by destination call buttons disposed remotely from the elevator in the passageways leading to the elevator. In other cases, the calls are entered either automatically by, or in response to pressing keys on, personal radio transmitters which transmit an identification (ID) number utilized to automatically enter a prearranged destination call or a key-selected call.

Typical problems with these systems include numerous false calls. Some of the false calls are caused by human error, particularly when ten-key entry panels are utilized, which is common in buildings having more than ten or twenty floors. Other false calls are registered as a consequence of pranks or vandalism. Still other false calls are caused by the person desiring to go to a destination other than his passively-entered, prearranged destination deciding not to enter the elevator yet (such as to purchase a newspaper on the way in) or simply changing his mind. Such systems have not had any adequate way to change calls, since there is a need to associate pressing of buttons on a destination call device with the ID number of a badge, the two of which are normally mutually exclusive ways of making calls. The use of destination call buttons, particularly in the landing during the morning rush, has been found to cause great delay in moving passengers onto the elevators, since typically lines are formed at each call entry panel. Because of the confusion and delay, passengers enter cars without having registered a call. In elevator systems utilizing destination hall calls, there typically is no car operating panel within each car, thereby providing no way to enter a car call once the passenger is in the car. Even if a car call could be entered in the elevator, the system would not know what previous destination call should be cancelled, since there is no way to associate the two. If one person simply cancelled a hall call or a destination call to some floor, other passengers wishing that service would lose it. If a passenger decides not to board or not to exit, the unnecessary floor stop unduly delays other passengers.

DISCLOSURE OF INVENTION

Objects of the invention include improved remote entry of elevator calls; improved automatic entry of elevator calls; improved revision of elevator calls; improved revision of elevator calls, including automatically entered elevator calls; reducing false calls in an elevator system responding to destination calls; reducing the response to false calls in an elevator system employing automatic destination calls; providing improvements in elevator system operation; and reduced elevator service time.

In accordance with the present invention, specific elevator calls, requested by an individual passenger, can be cancelled or changed by means of personal remote control devices which communicate with the elevator system by means of electromagnetic communications which include a specific identification number, thereby allowing the association of each service request with the passenger making the request.

According to the present invention, a personal remote control device responds to commands of the user to provide appropriate electromagnetic transmissions so as to cause the desired response in an elevator system, including the ability to cancel or change calls for service. Changes may include the case where a passenger enters the wrong elevator.

The present invention may be practiced with a personal remote control device which communicates verbally with the user or with a device which uses switches, displays and/or other means of communicating with the user.

The invention allows individual users to cancel previously requested calls, to change automatically entered calls, to change calls previously entered by the passenger, without subjecting the elevators to false stops, and without cancelling of stops related to other passengers' requests for service. The invention thereby permits use of destination call registration, without all of the wasteful, false call difficulties attendant destination call elevator systems known to the prior art. The invention allows switching calls assigned to one elevator, from that elevator to another elevator which the passenger has entered.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
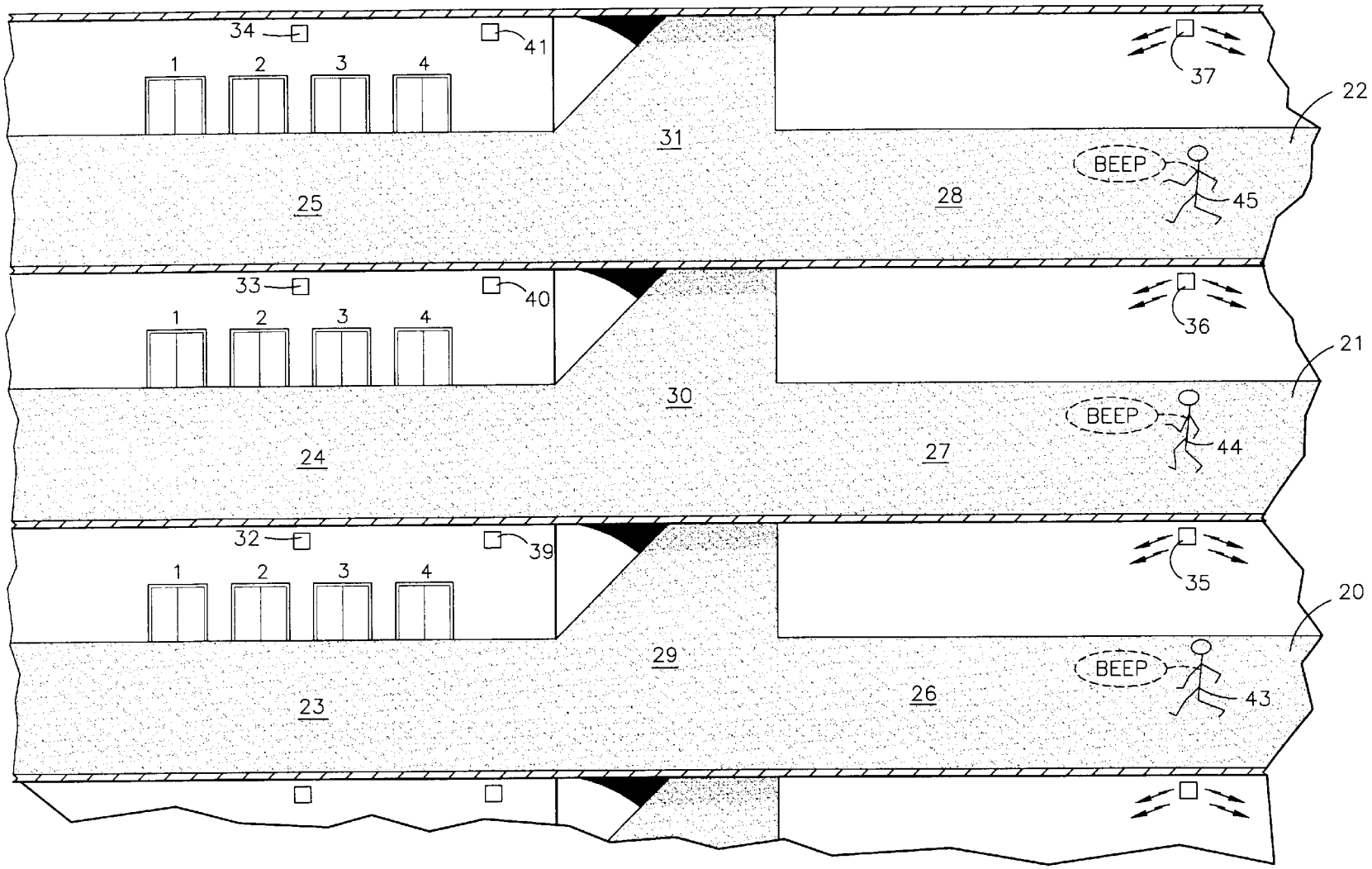
FIGS. 1–4 are partial, partially sectioned, perspective views of three floors of a building, illustrating a sequence of operation of the present invention as various persons approach elevator lobbies.
Figure 2:
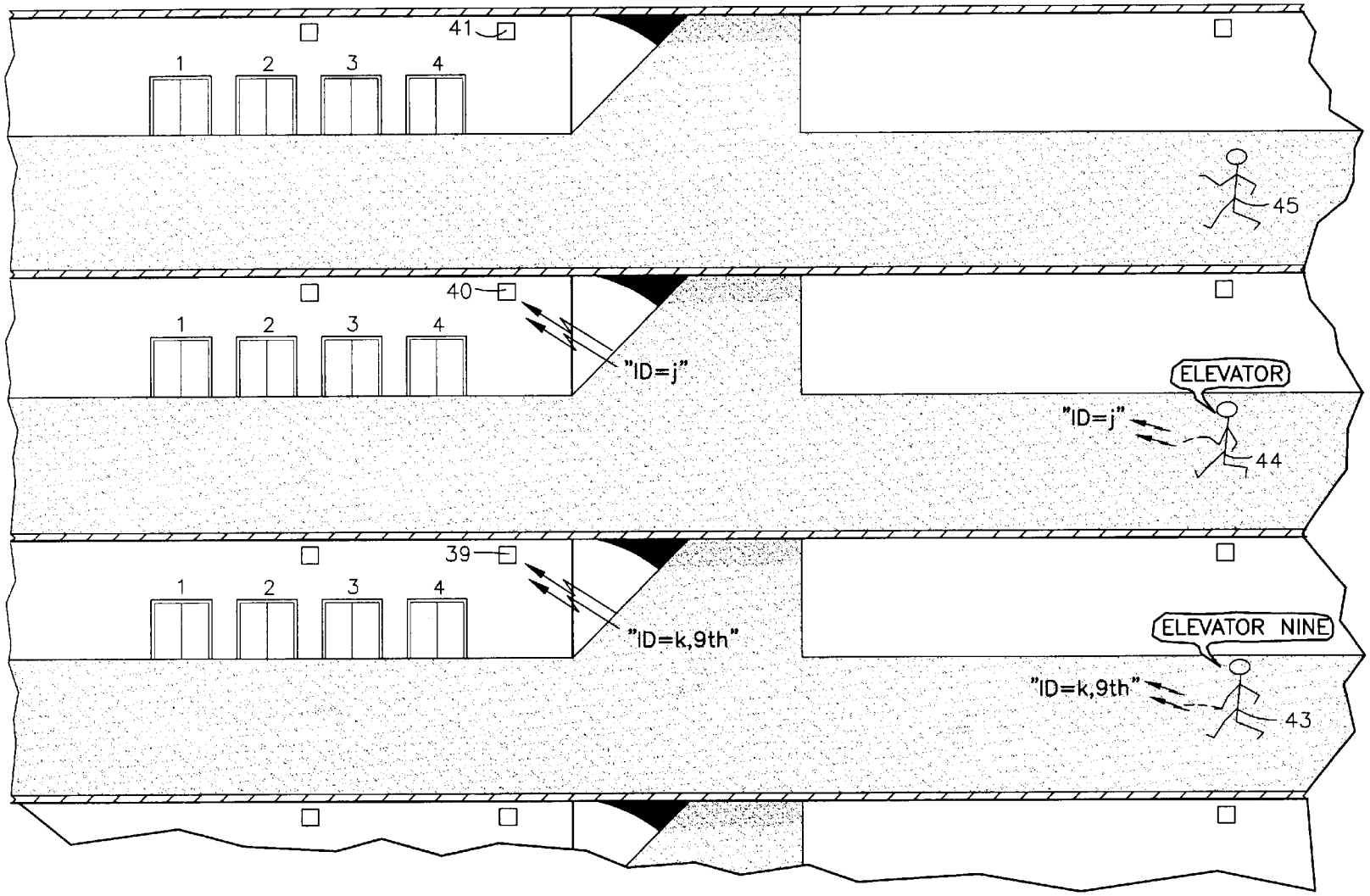

Referring now to FIG. 1, three floors of a building 20–22, each include an elevator landing 23–25, corresponding entrance corridors 26–28, and other corridors 29–31. Each of the corridors 26–28 has corresponding prompt beacons 32–37 that periodically (several times per second) transmit a prompt to alert devices of the invention (not shown in FIG. 1) that the general proximity of the elevators has been reached. The prompt is electromagnetic radiation, which may be selected from various available bands, such as 125 KHz or 315 MHz. Each of the elevator landings 23–25 has an electromagnetic transceiver 39–41 which can both transmit and receive messages by means of electromagnetic radiation. In FIG. 1, three persons 43–45 are shown entering corresponding corridors 26–28 at a time when each prompt transmitter 35–37 is transmitting an electromagnetic signal which comprises a beacon type prompt. Each person 43–45 is bearing a verbal remote control device not shown in FIGS. 1–8 for clarity. In response to the beacon prompt, each verbal remote control device will issue an audible prompt, such as a beep (FIG. 1), for the person bearing the device to hear. In response to the audible prompt, as is shown in FIG. 2, the persons 43 and 44 desirous of entering an elevator will respond verbally. On the fourth floor, the person 44 simply says "elevator", which causes the verbal remote control device borne by him to transmit, electromagnetically, a message which includes information such as "elevator requested", the identification number of the device (either k or j in the example of FIG. 2), and whether or not the bearer has indicated a desire to go to a floor other than the floor that the bearer normally goes to, referred to as the default floor herein. As seen in FIG. 2, it is assumed that the person 43 has requested the elevator to take him to the ninth floor, whereas the person 44 has requested the elevator, and decides to go to his default floor. In FIG. 2, the person 45 has said nothing, thereby indicating that he is not heading for the elevator. Alternatively, when prompted by the transceivers 34–36, the verbal remote control devices borne by the persons 43–45 might have synthesized the question "Elevator?", instead of using "beep" as a prompt. In reply to the request, the person 43 could have replied "yes . . . 9" or simply "9", and the person 44 could have simply replied "yes". In a system so devised, the person 45 might either remain silent or answer with the word "no". Optionally, the persons might use functional words to enter a specific call, such as "gym", "office" or "cafeteria". If desired, any human-discernable prompt, such as vibration (as in conventional paging units) may be used instead of audible prompts.

When the verbal remote control device on each person has received a verbal reply, it will transmit a corresponding message to a landing transceiver 39, 40, 41 (or a receiver positioned in any other suitable way), which includes the ID number of the device (person) and any request for a destination floor different from the default floor. In FIG. 2, the device borne by person 43 transmits a message identifying the person as that person having an assigned ID=k and requesting service to the 9th floor; the device borne by person 44 transmits a message that simply identifies the bearer as ID=j. The device on person 45 does not transmit any response, in this example.

Figure 3:
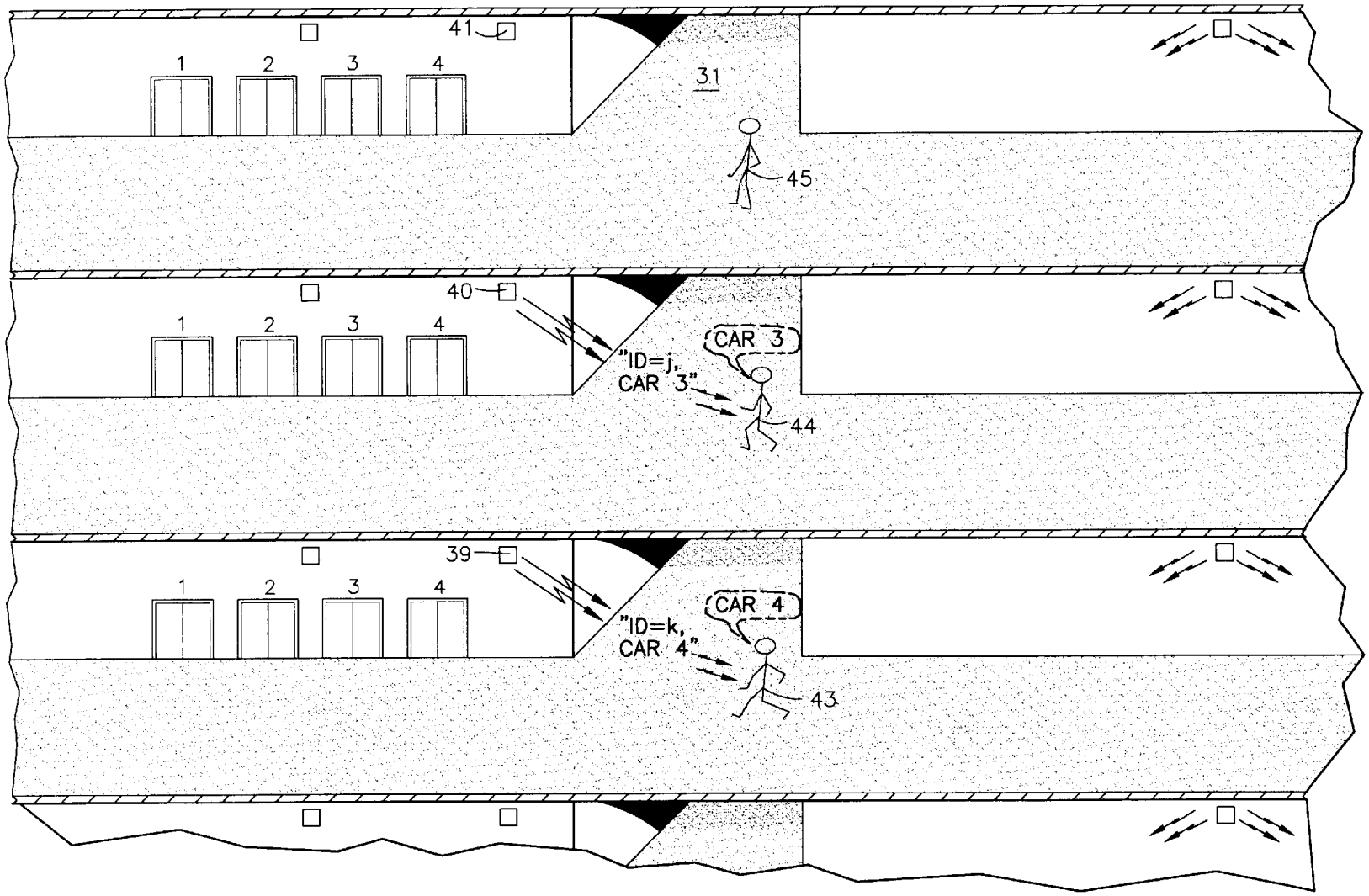

Once the transceivers 34, 35 have received messages indicative of the bearer's verbal response, the dispatcher of the elevator system, which may be any conventional dispatcher, enters a hall call for the corresponding floor (that is, floor 3 for person 43 and floor 4 for person 44), and also enters a destination request for the indicated floor (floor 9 for person 43) or the default floor if no request were made (for instance, floor 14 for person 44). The destination request is used in the dispatcher for making call allocations, but is not entered as a car call until the car stops at the origin floor, or optionally, until the related passenger enters the cab. The dispatcher then selects which of the elevators (car 1–car 4) is the most appropriate to respond to the combined hall call/car call. Once the assignment is made, it is communicated to the transceiver 39, 40 of the floor corresponding to the hall call (floor 3 and floor 4, respectively). In turn, each transceiver 39, 40 electromagnetically transmits a corresponding message which identifies the ID of the device entering the call request, as shown in FIG. 3. Thus, the transceiver 39 transmits a message including the information: the ID of the device requesting the call is k, and the call has been assigned to car four. Similarly, the transceiver 40 transmits a message including that the ID is j, and the call has been assigned to car 3. In response, the verbal remote control device of the present invention utilizes voice synthesis to announce the car assignment for the call through a loudspeaker to the bearer thereof as shown in FIG. 3. Thus, the verbal remote control device borne by the person 43 announces "car 4", and the verbal remote control device borne by the person 44 announces "car 3". Of course, no announcement is made to the person 45 who begins to turn the corner into the additional corridor 31.

Figure 4:
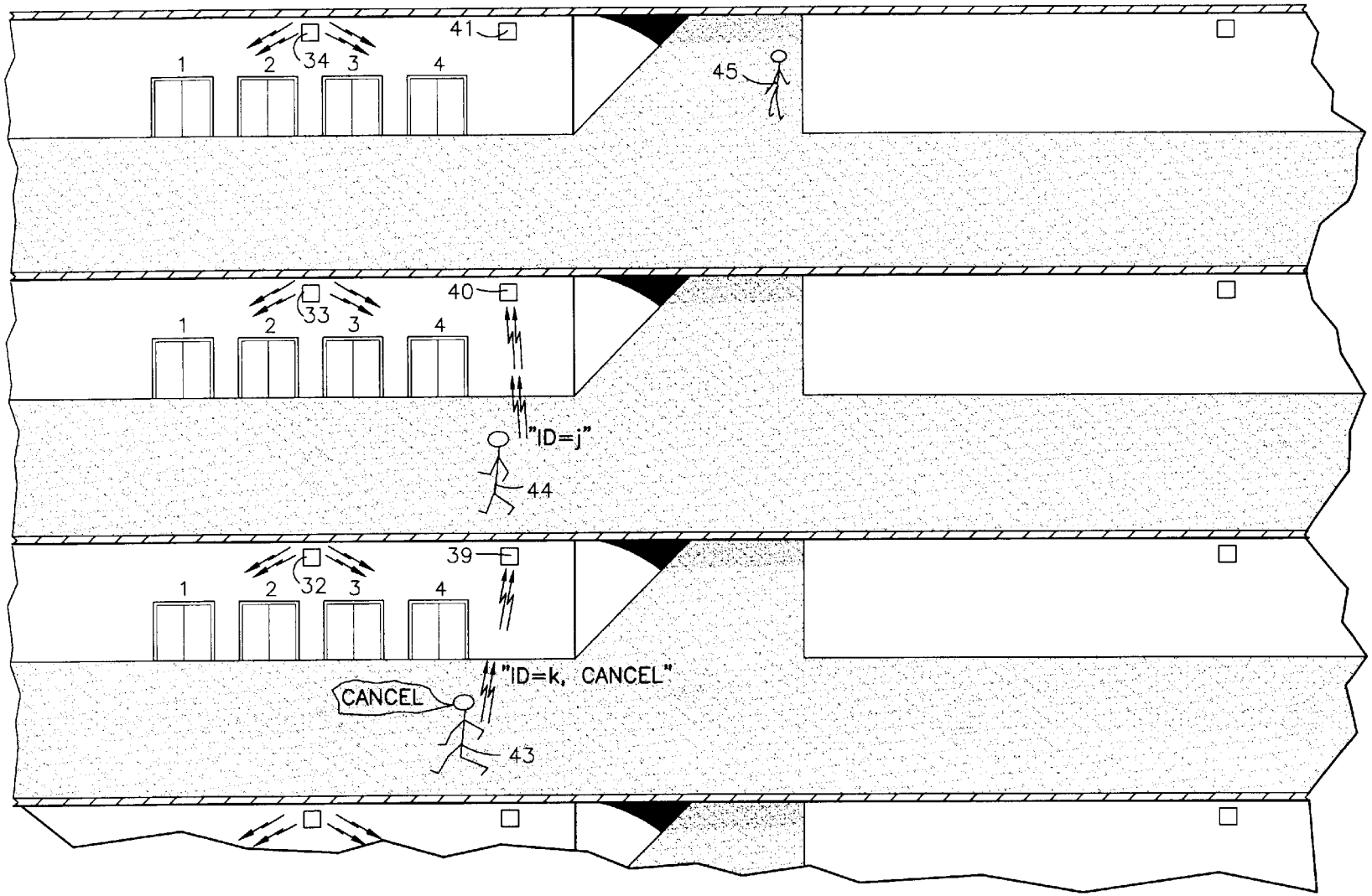

At this point in the sequence, the hall calls are all entered in cars for the pick up floors, the destination floors are noted, and the dispatcher knows the identification number of the persons (devices) who have requested those calls. As seen in FIG. 4, by the time an intended passenger reaches a corresponding one of the elevator landings 23–25, the verbal remote control device will be in range of a corresponding prompt beacon 32–34. Before or after reaching the landing 23, if the person 43 said "cancel", the verbal remote control device borne by him would transmit a message cancelling the hall call and destination call assigned to car 4 requested on floor 3 for the person whose device ID number is k. On the other hand, instead of cancelling the call, the person 43 could have said "19" or "office" to change the call. An important aspect of the invention is that service call messages by a unique device allows matching each new request with a specific previous request which must be concomitantly changed, according to this invention.

Figure 5:
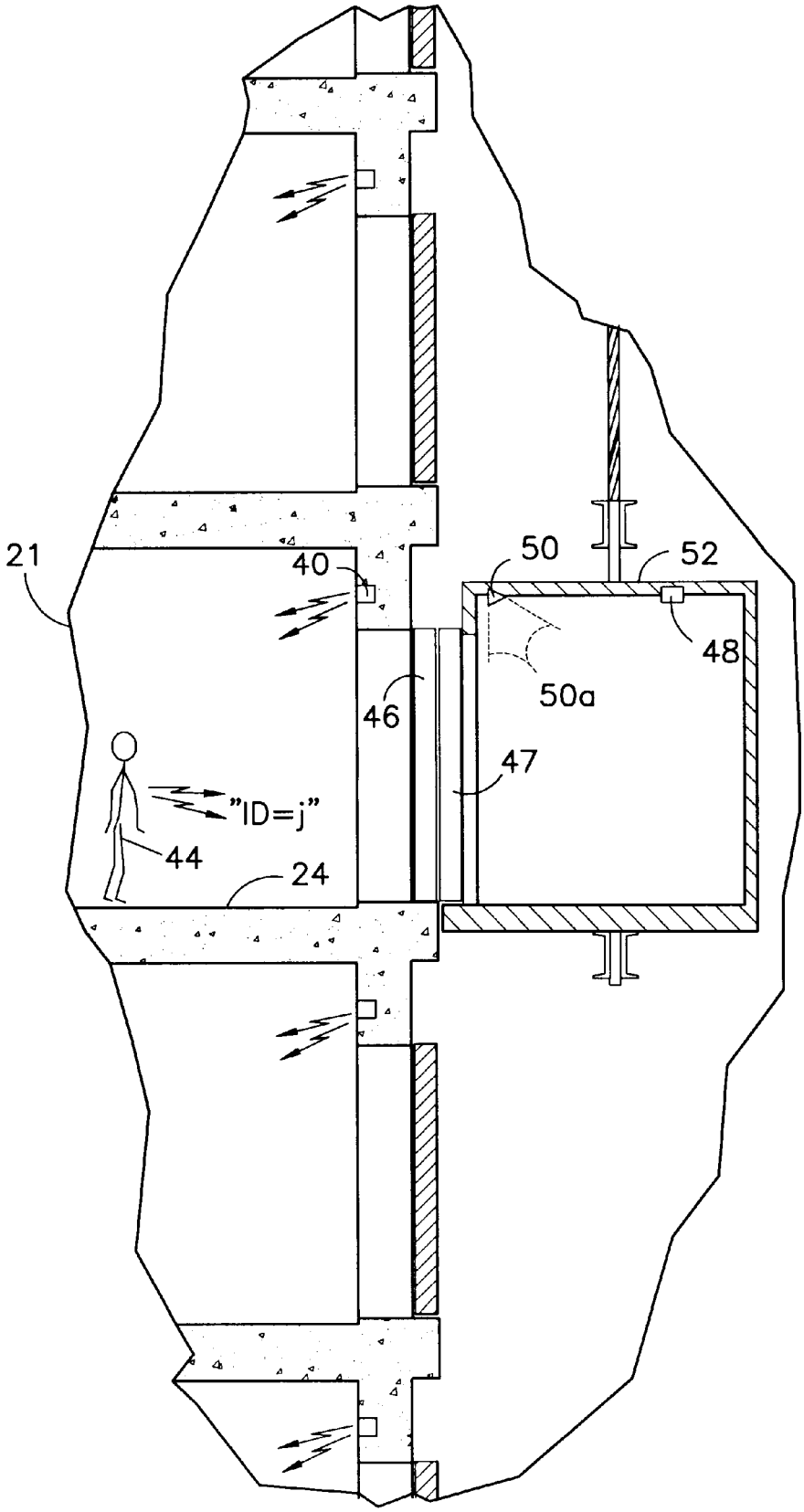
FIGS. 5–8 are partial, partially sectioned side elevation views of the elevator lobbies of FIGS. 1–4 illustrating additional sequences in accordance with the present invention.
Figure 6:
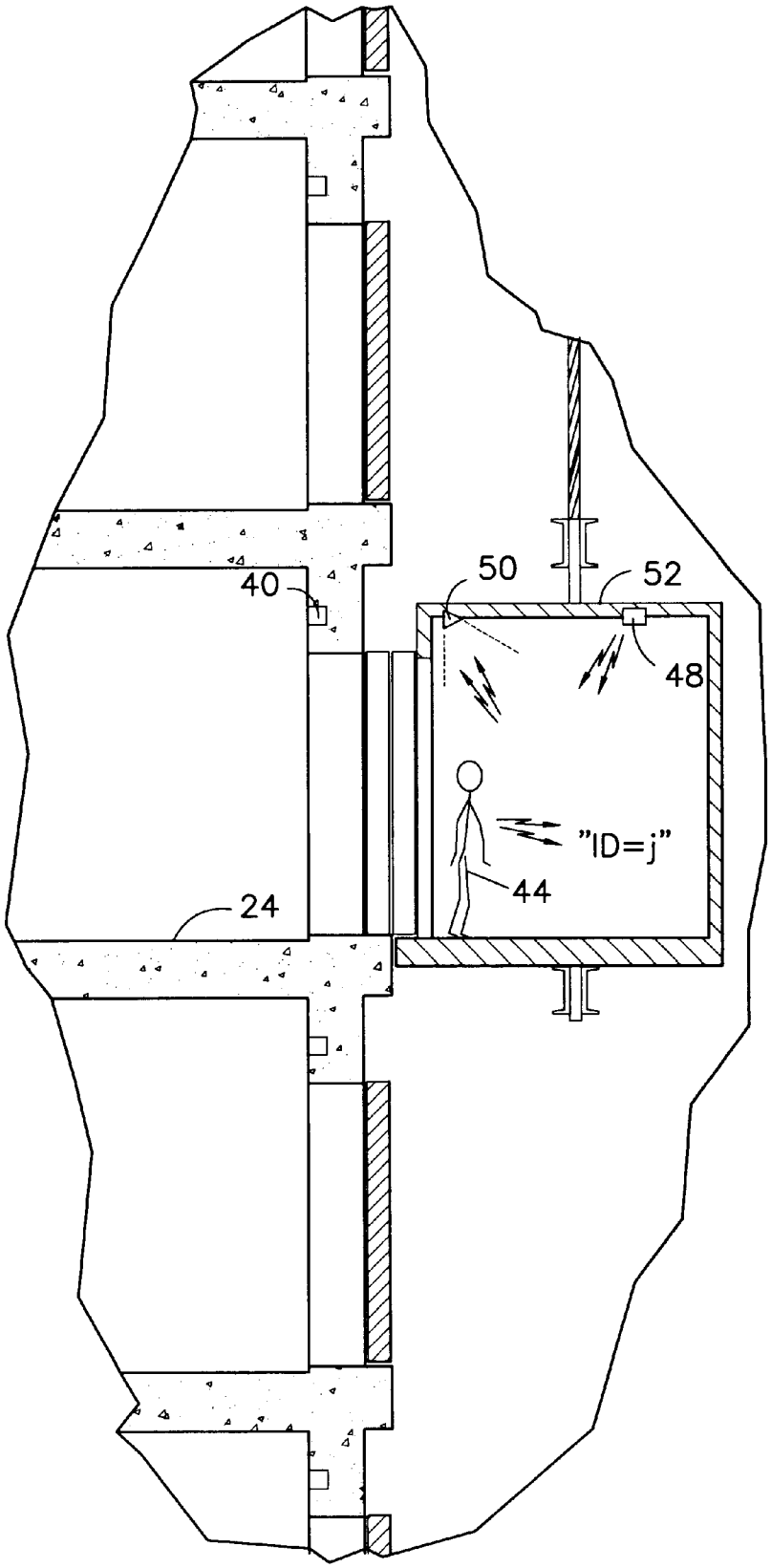

Referring now to FIG. 5, the person 44 is standing at the landing 24 waiting to enter elevator 3, the hoistway doors 46 and elevator doors 47 of which have just opened. A beacon 48 may cause response from each device in the car. A transceiver 50 within the cab 52 of elevator 3 is directional, as indicated by the dotted lines 53. This is to prevent the transceiver 50 from recognizing the transmissions from the verbal remote control device on the person 44, prior to the person 44 entering the cab 52, as illustrated in FIG. 6. Once the transceiver 50 receives transmissions from the verbal remote control device borne by the person 44, it is known that the person is within the cab 52.

Figure 7:
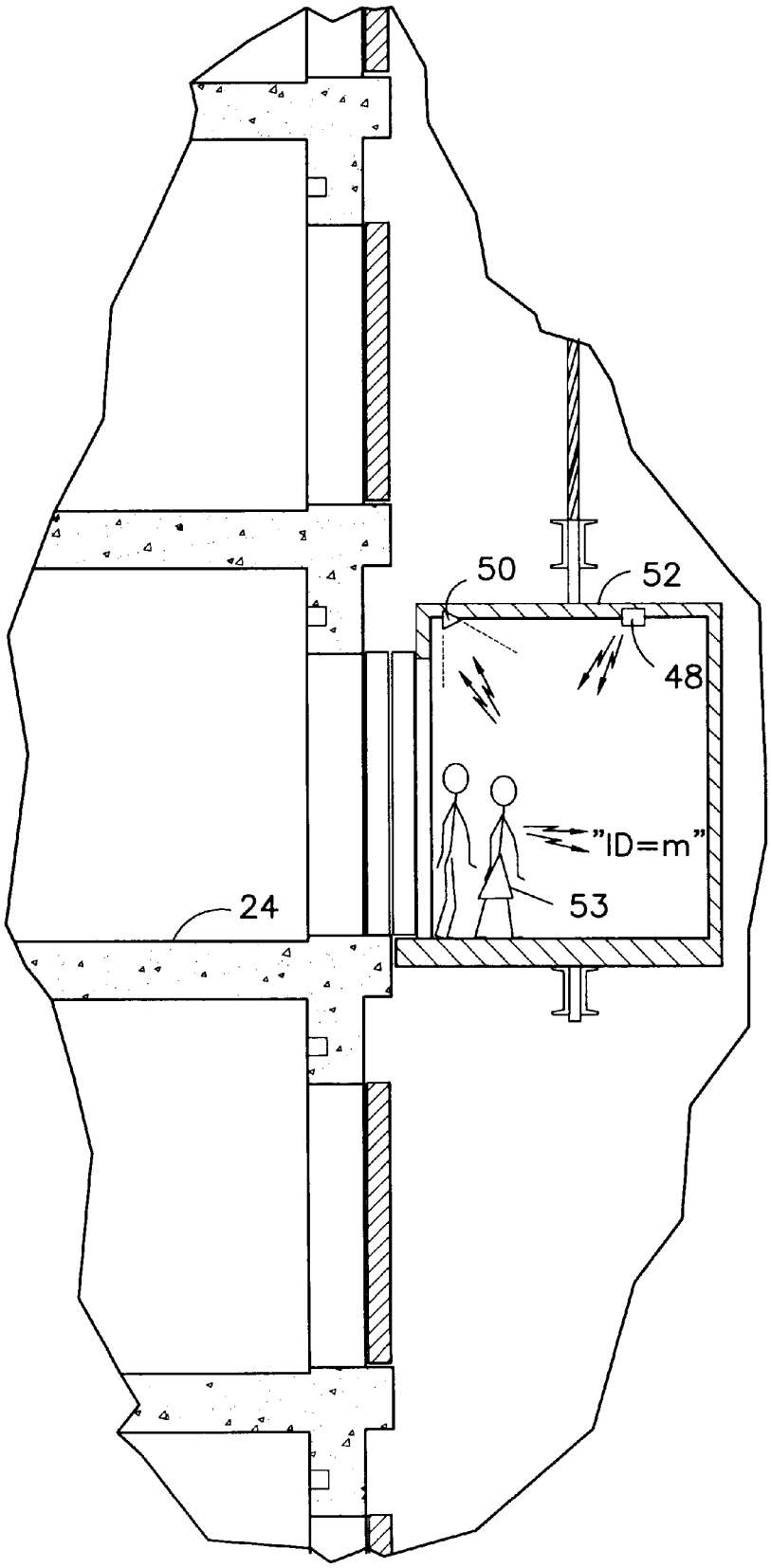
Figure 8:
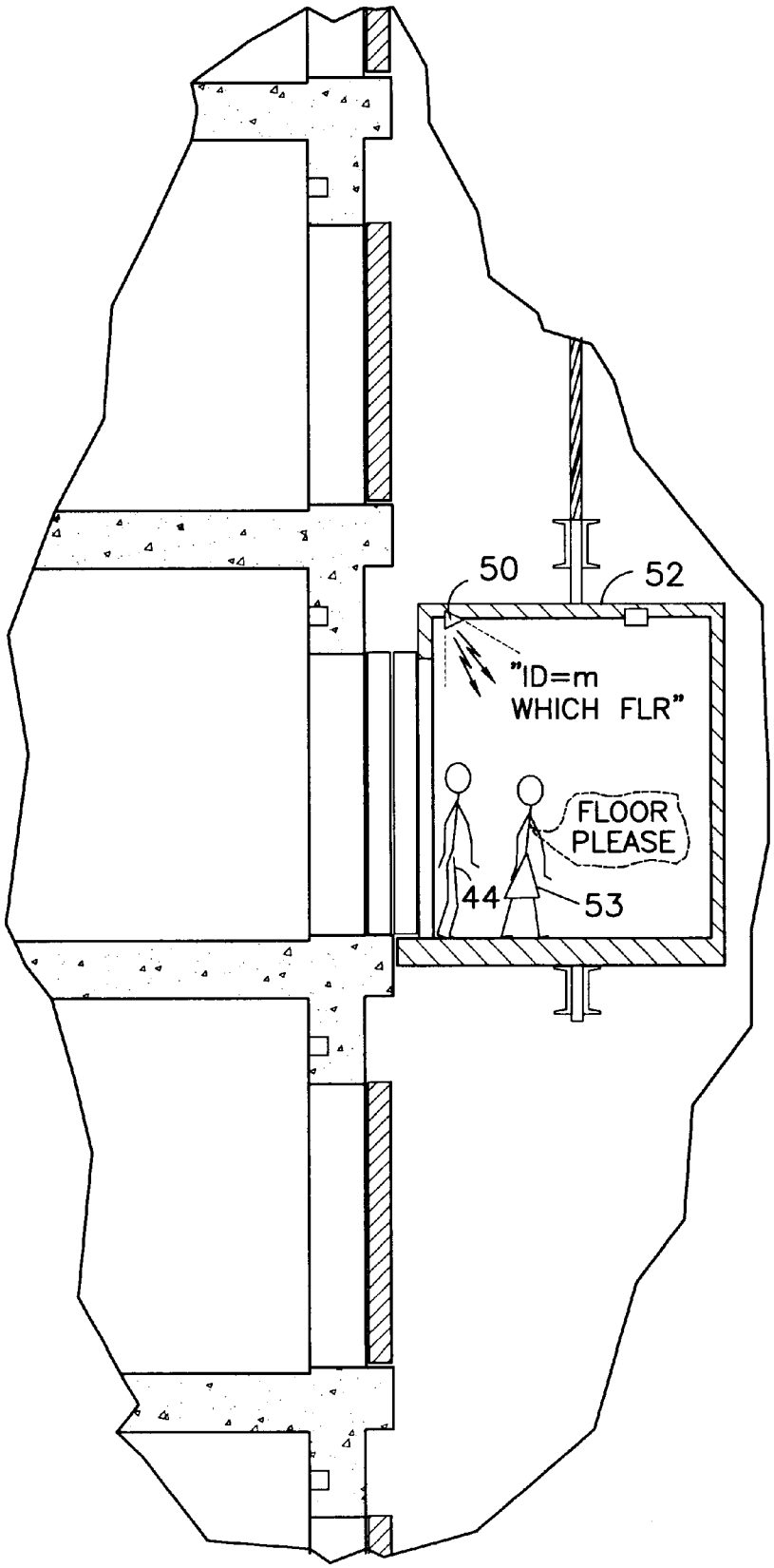

Referring to FIG. 7, if another person 54 who has been assigned to a different elevator at the fourth floor landing 24, nonetheless enters car 3, the verbal remote control borne by the person 54 will respond to a prompt from the beacon 48 to inform the transceiver 50 of that fact by means of an electromagnetically transmitted message including that the ID equals m. The ID number allows the dispatcher to cancel a car stop for this call within another car unless that call was also requested by another ID number; and the destination request may either be cancelled or retained. Either way, the dispatcher can inquire of the person's intentions, if desired. In such case, the dispatcher will cause the transceiver 50 to send an electromagnetic message to the verbal remote control device being borne by the person 54 having the ID number m, requesting which floor is desired by that person, as shown in FIG. 8. In response, the verbal remote control device borne by the person 54 will, by speech synthesis, express the command "floor please". Thus, the specific person can have the question addressed to her by her own verbal remote control device, rather than having a loudspeaker within the cab address the question to all of the passengers. As is true in common personal computers, the actual voice synthesis can have a very wide variety of sounds—high pitch, low pitch, young, old, male, female, and so forth—so that persons generally will be able to distinguish the voice synthesized words of their devices from those of other voice synthesizers in the vicinity. (Note that checkout persons can tell when the UPC sensor at their station has sounded, even though an identical sound is used at adjacent UPC stations.) After the verbal request is made of the person 54 by the voice synthesizer of the verbal remote control device borne thereby, the person 54 may state a floor number, which will then be transmitted electromagnetically from the verbal remote control device borne by the person 53 to the transducer 50 and thence by wire or other suitable communication modality to the dispatcher, so as to enter a call for the destination floor stated by the person 54. If person 54 does not state any floor information, of if in any embodiment no request is made of the person 54, the dispatcher could react to the previously recorded destination call requested for ID=m.

Figure 9:
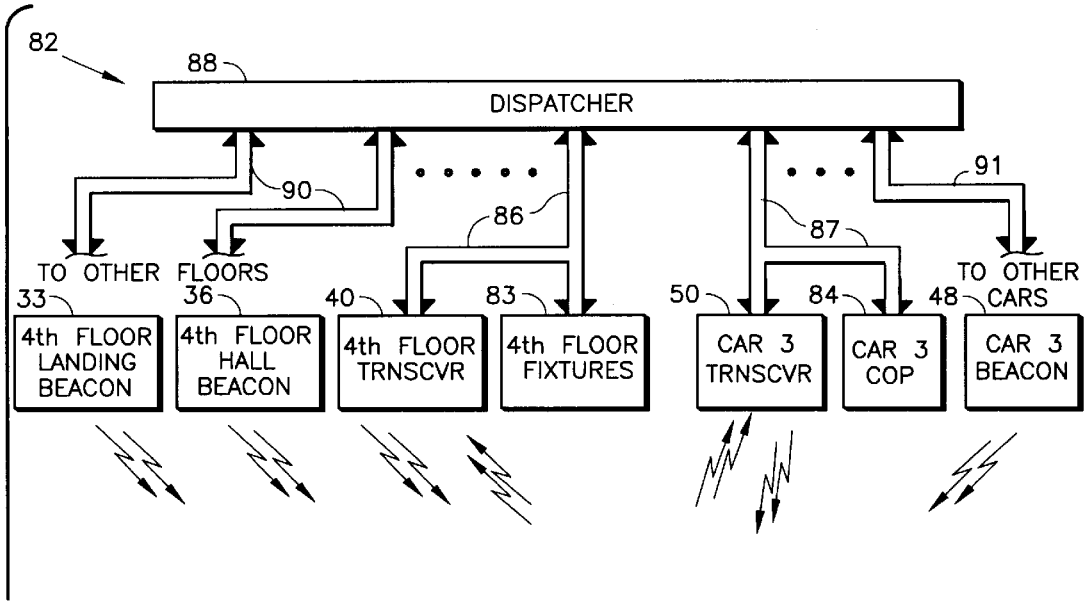
FIG. 9 is a simplified schematic block diagram of a remote control device and an elevator system which can practice the present invention.

Referring now to FIG. 9, a verbal remote control device 60, which may optionally be used in practicing the present invention, may include either a voice recognition function 62 which is connected to an acoustoelectric transducer such as a microphone 63 with which it can receive the words 64 of a person, such as the person 44, or it may include a voice synthesizer 69 which feeds an electroacoustic transducer such as a loudspeaker 70 so as to issue verbal information 71 to a person such as the person 44, or it may include both the apparatus 62, 63 and the apparatus 69, 70. The recognition 62 and the synthesis 69 will have appropriate connections 74, 75 to a microprocessor 76 which in turn has connections 77 to a transceiver 78. The transceiver 78 is connected to an antenna 79. The electromagnetic radiation used for message transmission is preferably at radio frequencies, rather than optical or near optical frequencies since it will pass through clothing easily and is not as easily blocked by other persons or objects. All of this is conventional, well within the skill of the art, and forms no part of the present invention.

In FIG. 9, an elevator system 82 with which the verbal remote control devices of the present invention may communicate includes at least one hall beacon for each hall (perhaps several per floor), such as the hall beacon 36 on the fourth floor corridor 27, a transceiver and a landing beacon for each landing, such as the transceiver 40 and beacon 33 for the fourth floor landing 24, and a car transceiver and beacon for each elevator car, such as the transceiver 50 and the beacon 48 on car 3. The present invention is designed to eliminate the need for conventional hall fixtures, such as fixtures 83 for the fourth floor landing 24, and is designed to eliminate the need for car call buttons provided on a car operating panel (COP), such as the COP 84 for car 3. However, to permit broadest utilization of the elevator system, including usage by persons not having access to a suitable remote control device, the fixtures 83 and COPs 84, including car call buttons, may be provided in any utilization of the present invention, if desired. The transceivers 40, 50, hall fixtures 83 and car operating panel 84 have normal connections 86, 87 to a dispatcher 88, which may be wires or other suitable communication modality. The dispatcher 88 is provided with suitable connections 90 to other floors, and suitable connections 91 to other cars.

The voice recognition function 62 and voice synthesis function 69 may take any suitable form, such as an RSC-164 voice recognition chip provided by Sensory Inc., Sunnyvale, Calif., which includes both voice recognition and synthesis. The microprocessor 76 may be any suitable microprocessor, and may preferably be one which can enter into an inactive or sleep mode, and be responsive only to receipt of a beacon prompt command through the antenna 79 and the transceiver 78 to wake it up and initialize it for enabling the voice recognition 62 and the voice synthesis 69. Alternatively, if beacons are not used, the bearer may wake up the device with a switch, which may respond to the device being shaken or slapped, or to pressing a push button switch 80. Such a microprocessor may be formulated with a PIC 16C84 for example, or any other suitable microprocessor. The transceiver 78 is conventional, regardless of the particular design chosen in any implementation of the present invention.

Figure 10:
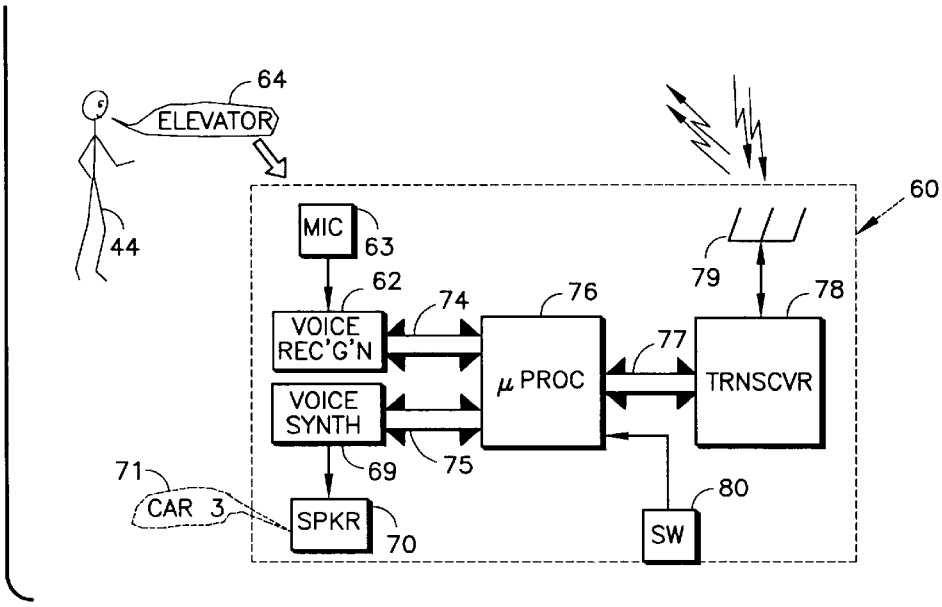
FIG. 10 is a simplified diagram of another form of remote control device for use with the system of FIG. 8.
Figure 10:
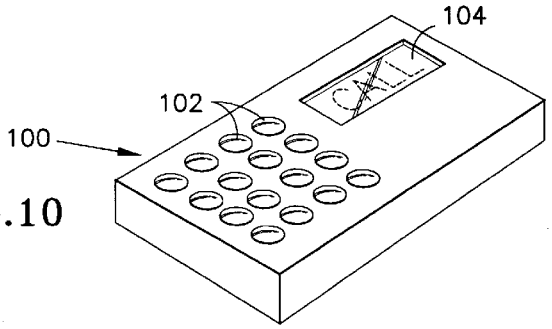

Instead of a verbal remote control device, the invention may be practiced with a remote control device which uses switches and a display to communicate with the user. In FIG. 10, a remote control device 100 has a plurality of switch buttons 102, which may include a device wake-up button, if needed, a call cancellation button, and buttons to enter elevator service calls, which may be numerical, one per floor or ten-key, or which may have prearranged functional significance, such as office, lobby, gym, etc., or both. The device may have a display 104 to issue requests and to inform the user, such as of an assigned car.

The foregoing application, and the details thereof, are by way of example only. The invention may as well be used to control other domestic, commercial and industrial apparatus. Thus, although the invention has been shown and described with respect to exemplary embodiments thereof, it should be understood by those skilled in the art that the foregoing and various other changes, omissions and additions may be made therein and thereto, without departing from the spirit and scope of the invention.

The aforementioned patent application is incorporated herein by reference.

I claim:

1. An elevator system, comprising:

a plurality of elevators each having a car moveable within a related hoistway for transporting passengers vertically between floors of a building;

a controller for receiving call messages initiated by passengers requesting elevator service from an origin floor to a destination floor, for providing hall stop commands to said elevators to cause a selected elevator to provide service in response to related ones of said call messages, and for providing car stop commands to said elevators to cause each said selected elevator to stop at a corresponding destination floor;

a receiver for receiving electromagnetic messages transmitted in proximity therewith and for providing said messages to said controller; and a plurality of remote control devices to be borne and used by passengers in requesting elevator service, each said remote control device having a transmitter for transmitting electromagnetic call messages to said receiver for transfer to said controller;

characterized by the improvement comprising:

each call message transmitted by said devices including a component identifying the particular device that transmitted the message; and said remote control devices each having passenger activated means for initiating transmission of a call cancellation message including a component identifying the particular device that transmitted the cancellation message.

2. A system according to claim 1 wherein said passenger activated means comprises means for initiating transmission of a call cancellation message which includes a component identifying a destination floor designated by said passenger activated means.

3. A system according to claim 1 wherein said passenger activated means comprises a switch.

4. A system according to claim 1 wherein said passenger activated means comprises a switch for initiating a call cancellation message and floor selection switches for initiating a destination floor component of one of said call messages.

5. A system according to claim 4 wherein said floor selection switches are numerical and enable entry of any possible destination floor for the passenger bearing said device.

6. A system according to claim 4 wherein said floor selection switches are identified by functional units and operation of which initiate corresponding destination floor component.

7. A system according to claim 1 wherein said passenger activated means comprises:

an acoustoelectric transducer for receiving verbal messages spoken by a person in the immediate proximity of said device; and signal processing means responsive to said acoustoelectric transducer for recognizing one of a set of phrases in at least one common language, said set of phrases including a call cancellation phrase, for providing related signals indicative of the meaning of any phrase so recognized, for providing, to said transmitter, signals representing a predetermined corresponding message in response to said related signals, and for causing said transmitter to transmit said corresponding message.

8. An elevator system according to claim 1, further comprising:

a plurality of transmitters, one on each of said floors;

a receiver in each of said devices; and means associated with each of said transmitters to send request messages, including said device identifying component, to said devices to request initiation of one of said call messages; and each device having prompt means to provide a human-discernable prompt to the bearer of said device upon receipt by the corresponding receiver of one of said request messages including the device identifying component related to said device.

9. An elevator system according to claim 8 wherein said prompt means comprises:

signal processing means responsive to said request messages for providing voice synthesis signals representing a predetermined one of a set of spoken phrases corresponding to said request message; and an electroacoustic transducer responsive to said voice synthesis signals for acoustically transmitting the spoken phrase corresponding thereto in a manner audible to a person in the immediate proximity of said device.

10. A method of correcting calls for service in a multi-elevator system having a controller for allocating calls to selected elevators, comprising:

providing at each access floor a receiver for receiving electromagnetic messages transmitted in proximity therewith and for providing said messages to said controller;

providing passengers with remote control devices for requesting elevator service, said remote control devices having a transmitter for transmitting electromagnetic messages to said receiver for transfer to said controller, each message transmitted by said device including a component identifying the particular device that transmitted the message, and having passenger activated means for initiating transmission of a call cancellation message and for initiating transmission of a call message which includes a component identifying a destination floor designated by said passenger activated means;

initiating transmission of a call message from one of said devices for a first destination floor;

initiating transmission of a call cancellation message from said one of said devices;

cancelling any car stop for a call requested by said one of said devices and not requested by any other device; and initiating a call message from said one of said devices for a second destination floor.

11. A method of correcting calls for service in a multi-elevator system having a controller for allocating calls to selected elevators, comprising:

(a) providing at each access floor a receiver for receiving electromagnetic messages transmitted in proximity therewith and for providing said messages to said controller;

(b) providing passengers with remote control devices for requesting elevator service, said remote control devices having a transmitter for transmitting electromagnetic call messages to said receiver for transfer to said controller, each call message transmitted by said device including a component identifying the particular device that transmitted the message;

characterized by the improvement comprising:

(c) said step (b) comprising providing passengers with remote control devices having passenger activated means for initiating transmission of a call message which includes a destination component identifying a destination floor designated by said passenger activated means;

(d) assigning a call requested by each said call message to one of said elevators;

(e) sending an identifying message from each device upon such device entering one of said elevators, said identifying message including said device identifying component; and (f) in the event that the identifying component of any such device entering one elevator is the same as the identifying component of a particular call assigned to another of said elevators, cancelling said particular call in said another of said elevators unless also requested by another of said devices.

12. A method according to claim 11, further comprising:

(g) assigning said particular call to said one elevator.

13. A method according to claim 11 wherein said step (b) further comprises:

(h) providing passengers with remote control devices which each have a receiver and means to provide a human discernible prompt to alert the bearer thereof to request a new destination; and further comprising:

(i) transmitting in said one elevator a new destination prompt message having the same identification as the identifying component related to said particular call which is cancelled to activate said means to provide a human discernible prompt; and (j) in response to said prompt, initiating a call message from said one such device.

14. A method of correcting calls for service in a multi-elevator system having a controller for allocating calls to selected elevators, comprising:

providing at each access floor a receiver for receiving electromagnetic messages transmitted in proximity therewith and for providing said messages to said controller;

providing passengers with remote control devices for requesting elevator service, said remote control devices having a transmitter for transmitting electromagnetic messages to said receiver for transfer to said controller, each message transmitted by said device including a component identifying the particular device that transmitted the message, and having passenger activated means for initiating transmission of a call cancellation message and for initiating transmission of a call message which includes a component identifying a destination floor designated by said passenger activated means;

initiating transmission of a call message from one of said devices for a first destination floor;

assigning a call requested by each said call message to one of said elevators;

sending an identifying message from each device upon such device entering one of said elevators, said identifying message including said device identifying component;

in the event that the identifying component of any such device entering any elevator is the same as the identifying component of a particular call assigned to another of said elevators, cancelling said particular call in said another of said elevators; and in the event that a call cancellation message is transmitted from said one of said devices, cancelling any car stop of said one elevator for a call cancelled by said one of said devices and not requested by another device.

15. A method of correcting calls for service in a multi-elevator system having a controller for allocating calls to selected elevators, comprising:

(a) providing at each access floor a receiver for receiving electromagnetic messages transmitted in proximity therewith and for providing said messages to said controller;

(b) providing passengers with remote control devices for requesting elevator service, said remote control devices having a transmitter for transmitting electromagnetic messages to said receiver for transfer to said controller, each message transmitted by said device including a component identifying the particular device that transmitted the message, and having passenger activated means for initiating transmission of a call cancellation message and for initiating transmission of a call message which includes a component identifying a destination floor designated by said passenger activated means;

(c) initiating transmission of a call message from one of said devices for a first destination floor;

(d) assigning a call requested by each said call message to one of said elevators; and (e) in the event that a call cancellation message is transmitted from said one of said devices cancelling any car stop of said one elevator for a call cancelled by said one of said devices and not requested by another device.

16. A method according to claim 15 further comprising:

(g) after said step (e), initiating transmission of a call message from said one of said devices for a second destination floor.

* * * * *